US011679606B2

(12) United States Patent
Yoneyama et al.

(10) Patent No.: US 11,679,606 B2
(45) Date of Patent: Jun. 20, 2023

(54) PRINTING APPARATUS, CONTROL METHOD, AND STORAGE MEDIUM

(71) Applicant: CANON KABUSHIKI KAISHA, Tokyo (JP)

(72) Inventors: Hiromasa Yoneyama, Kanagawa (JP); Yasuyuki Asai, Tokyo (JP); Ryohei Maruyama, Kanagawa (JP); Itaru Wada, Kanagawa (JP); Yoshiaki Suzuki, Chiba (JP); Tomohito Abe, Kanagawa (JP); Tsutomu Obata, Tokyo (JP); Noriyuki Aoki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 248 days.

(21) Appl. No.: 17/120,422

(22) Filed: Dec. 14, 2020

(65) Prior Publication Data

US 2021/0197592 A1 Jul. 1, 2021

(30) Foreign Application Priority Data

Dec. 27, 2019 (JP) ..... JP2019-239281

(51) Int. Cl.

| | |
|---|---|
| ***B41J 11/66*** | (2006.01) |
| ***B41J 11/70*** | (2006.01) |
| ***B65H 35/06*** | (2006.01) |
| ***B26D 1/24*** | (2006.01) |

(52) U.S. Cl.

CPC ..... *B41J 11/706* (2013.01); *B26D 1/245* (2013.01); *B65H 35/06* (2013.01)

(58) Field of Classification Search

None

See application file for complete search history.

(56) References Cited

U.S. PATENT DOCUMENTS

| | | | | |
|---|---|---|---|---|
| 5,640,232 | A | 6/1997 | Miyake et al. | |
| 6,002,849 | A | 12/1999 | Koh et al. | |
| 10,286,691 | B2 | 5/2019 | Chino et al. | |
| 2003/0210290 | A1* | 11/2003 | Suzuki | B41J 11/706 347/9 |
| 2019/0111712 | A1* | 4/2019 | Nonaka | B41J 29/02 |

FOREIGN PATENT DOCUMENTS

| | | | | |
|---|---|---|---|---|
| EP | 579416 | A2 * | 1/1994 | B41J 11/706 |
| JP | 09029685 | A * | 2/1997 | |
| JP | 2004358621 | A * | 12/2004 | |
| JP | 2008207408 | A * | 9/2008 | B41J 11/706 |
| JP | 2018-161772 | A | 10/2018 | |

OTHER PUBLICATIONS

U.S. Appl. No. 17/120,447, filed Dec. 14, 2020 (First Named Inventor: Yasuyuki Asai).

U.S. Appl. No. 17/120,645, filed Dec. 14, 2020 (First Named Inventor: Tomohito Abe).

* cited by examiner

*Primary Examiner* — Leslie J Evanisko

(74) *Attorney, Agent, or Firm* — Venable LLP

(57) ABSTRACT

There is provided with printing apparatus. A printing unit prints an image on a printing medium and is able to move. A cutter unit is able to connect with or separate from the printing unit, and, by following a movement of the printing unit, cuts the printing medium. A control unit, in a case where a predetermined condition is satisfied after the printing medium is cut by the cutter unit, causes the printing unit to perform printing on a succeeding printing medium, while moving the printing unit in a state in which the cutter unit is connected with the printing unit.

20 Claims, 13 Drawing Sheets

PRINTING APPARATUS, CONTROL METHOD, AND STORAGE MEDIUM

BACKGROUND OF THE INVENTION

Field of the Invention

The present invention relates to a printing apparatus, a control method, and a storage medium.

Description of the Related Art

In a printing apparatus that performs printing on a long printing medium such as roll paper, cutting of a printing medium after printing may be performed. In Japanese Patent Laid-Open No. 2018-161772, a printing apparatus that performs cutting of a printing medium by connecting a carriage and a cutter unit and then causing the cutter unit to follow the carriage is described.

SUMMARY OF THE INVENTION

According to one embodiment of the present invention, a printing apparatus, comprises: a printing unit configured to print an image on a printing medium and configured to be able to move; a cutter unit configured to be able to connect with or separate from the printing unit, and configured to, by following a movement of the printing unit, cut the printing medium; and a control unit configured to, in a case where a predetermined condition is satisfied after the printing medium is cut by the cutter unit, cause the printing unit to perform printing on a succeeding printing medium, while moving the printing unit in a state in which the cutter unit is connected with the printing unit.

According to another embodiment of the present invention, a control method of a printing apparatus comprising a printing unit configured to print an image on a printing medium and configured to be able to move; and a cutter unit configured to be able to connect with or separate from the printing unit, and configured to, by following a movement of the printing unit, cut the printing medium, the method comprises: controlling, in a case where a predetermined condition is satisfied after the printing medium is cut by the cutter unit, to cause the printing unit to perform printing on a succeeding printing medium while moving the printing unit in a state in which the cutter unit is connected with the printing unit.

According to still another embodiment of the present invention, a non-transitory computer-readable storage medium storing a computer program for causing a method performed by a printing apparatus comprising: a printing unit configured to print an image on a printing medium and configured to be able to move; and a cutter unit configured to be able to connect with or separate from the printing unit, and configured to, by following a movement of the printing unit, cut the printing medium, the method comprises: controlling, in a case where a predetermined condition is satisfied after the printing medium is cut by the cutter unit, to cause the printing unit to perform printing on a succeeding printing medium while moving the printing unit in a state in which the cutter unit is connected with the printing unit.

Further features of the present invention will become apparent from the following description of exemplary embodiments (with reference to the attached drawings).

DESCRIPTION OF THE EMBODIMENTS

In the above conventional technique, after printing of an image to a printing medium is ended, a carriage moves to a home position of a cutter unit and then makes a connection with a cutter unit. Therefore, in a case where printing of images is performed in sequence while cutting the printing medium into pages, the carriage moves to the home position of the cutter unit after every cut, and the connection between the carriage and the cutter unit is disengaged. As a result, the movement distance of the carriage may increase and the throughput of the printing apparatus may suffer.

An embodiment of the present invention provides a technique that improves the throughput of a printing apparatus.

Hereinafter, embodiments will be described in detail with reference to the accompanying drawings. Note, the following embodiments are not intended to limit the scope of the claimed invention. Although several features are described in the embodiments, these features are not all necessarily required for the invention, and multiple features may be combined as desired. Furthermore, in the accompanying drawings, the same or similar configurations are given the same reference signs, and redundant descriptions thereof will be omitted.

Note that "printing" encompasses not only cases where meaningful information such as text and figures are formed but also cases where broadly, an image, a design, a pattern, and the like—irrespective of whether they are meaningful or meaningless—are formed on a printing medium or processing of a medium is performed, and it does not matter whether or not what is formed is a manifestation that can be perceived through vision by a person. Also, although sheet-like paper is envisioned as "printing medium" in the present embodiment, "printing medium" may be fabric, a plastic film, and the like.

First Embodiment

<Overview of Printing Apparatus>

Figure 1:
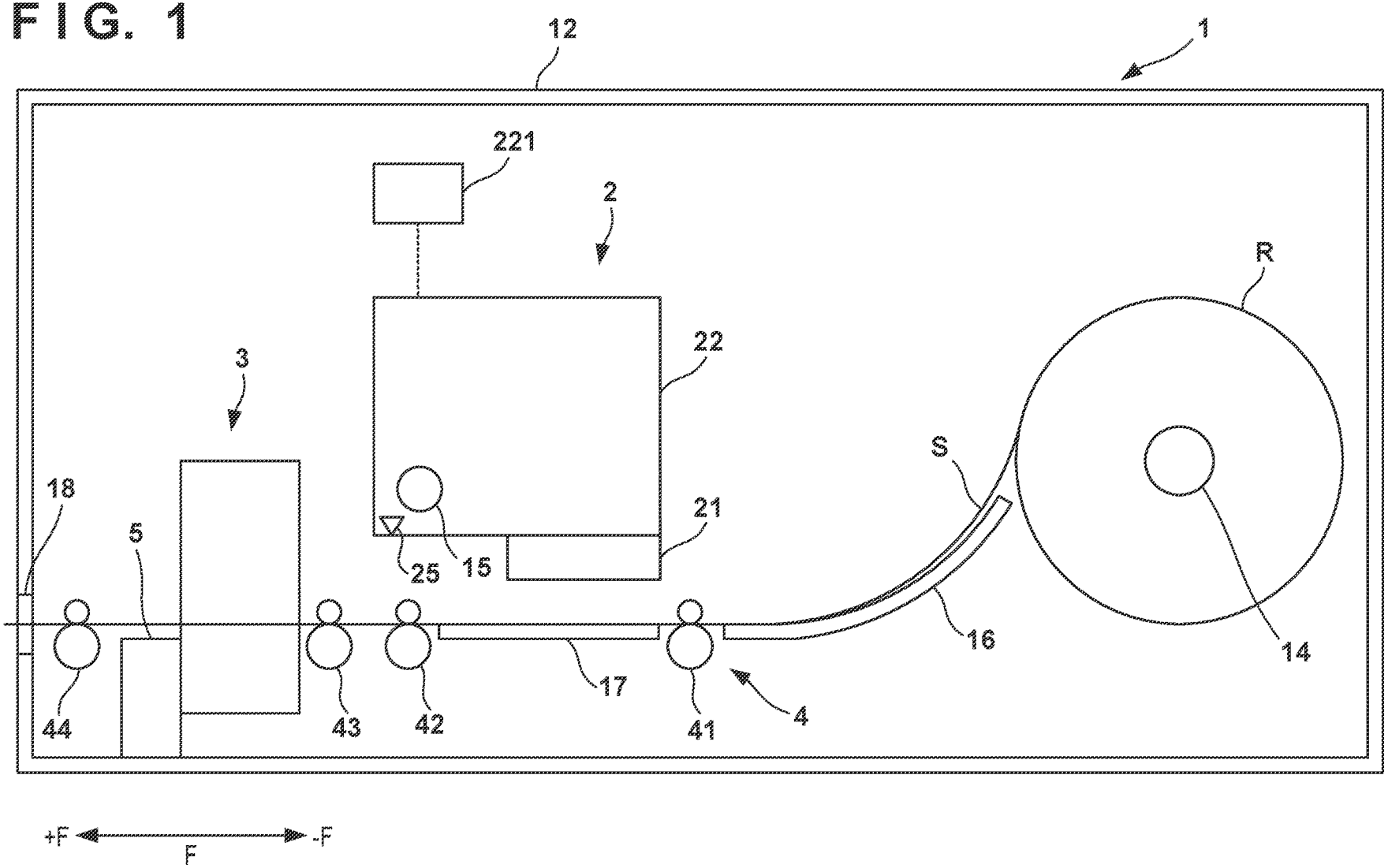
FIG. 1 is a side view that schematically illustrates an internal structure of a printing apparatus according to an embodiment.
Figure 2:
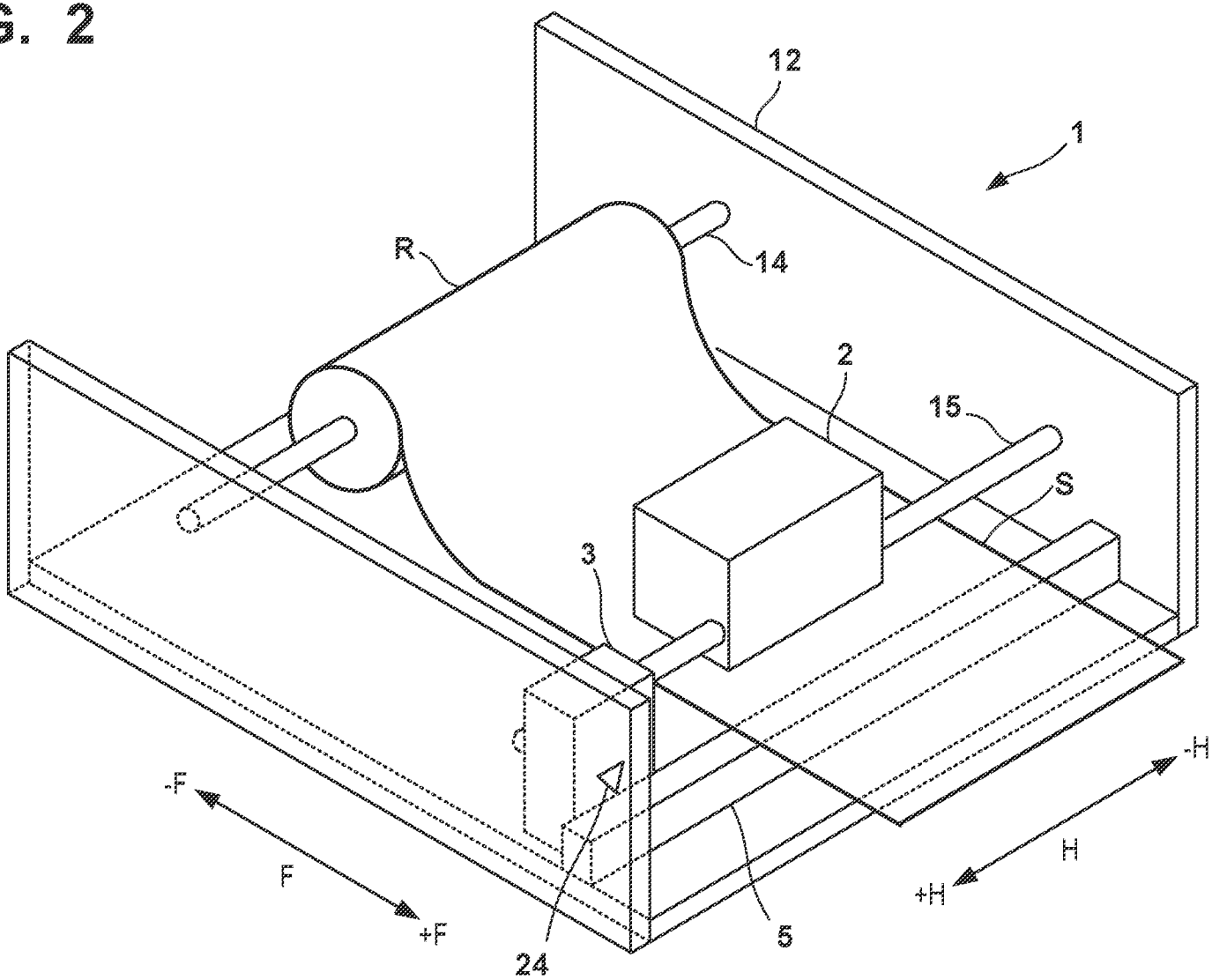
FIG. 2 is a perspective view that schematically illustrates a configuration of the printing apparatus in FIG. 1.

FIG. 1 is a view that schematically illustrates an internal structure of a printing apparatus 1 according to an embodiment. FIG. 2 is a perspective view that schematically illustrates a configuration of the printing apparatus 1 in FIG. 1. Note that in FIG. 1 and FIG. 2, illustration of some of the configurations is omitted. Also, a movement direction of a printing unit 2 will be a main scanning direction H, and a direction that intersects the main scanning direction H will be an auxiliary scanning direction F. Also, for the sake of descriptive convenience, one side in the direction of the main scanning direction H will be referred to as a +H side, and the other, a −H side; and one side in the direction of the auxiliary scanning direction F will be referred to as a +F side, and the other, a −F side.

The printing apparatus 1 is an inkjet printer, and each constituent component is arranged within a housing 12. The printing apparatus 1 pulls out a printing medium S from a roll (roll paper) R which is the wound printing medium S and then prints an image on the printing medium S. The roll R is supported so as to be able to rotate on a spool 14. Also, the printing apparatus 1 includes the printing unit 2, a cutter unit 3, and a conveyance unit 4.

The printing unit 2 prints an image on the printing medium S. In the present embodiment, the printing unit 2 has a printhead 21 and a carriage 22 on which the printhead 21 is arranged.

The printhead 21 prints an image by discharging ink on the printing medium S. The ink that the printhead 21 discharges is supplied from an ink tank (not illustrated). The ink tank may be arranged in the carriage 22 or may be arranged somewhere within the housing 12 and supply ink to the printhead 21 by a supply member such as a tube.

The carriage 22 is guided by a guide member 15 and is arranged so as to be able to move back and forth in the main scanning direction H. In the present embodiment, the carriage 22 moves back and forth using a carriage motor 221 as a driving source. The position of the carriage 22 in the main scanning direction H is detected by a sensor (not illustrated). Such a sensor may be configured by, for example, an encoder scale that is arranged to extend in the main scanning direction H and an encoder sensor that is arranged in the carriage 22 and reads the encoder scale.

Also, in the present embodiment, a home position HP2 of the carriage 22 is arranged at the end of the main scanning direction −H side, which is one end of the movement range of the carriage 22 (refer to FIG. 10). Then, by the printhead 21 discharging ink on the printing medium S while the carriage 22 moves from the home position HP2 in a +H direction, an image is printed on the printing medium S.

Also, in the present embodiment, the printing unit 2 comprises a sensor 25 that detects the edge of a sheet of the printing medium S in the main scanning direction H. The printing apparatus 1 can acquire the width of a sheet of the printing medium S by the sensor 25. As the sensor 25, light-reflective optical sensors, ultrasonic sensors, and the like, for example, may be used.

The cutter unit 3 is what cuts the printing medium S on which printing was performed by the printing unit 2 and is arranged further on the +F side than the printing unit 2 in the auxiliary scanning direction F, in other words, on the downstream side in the conveyance direction of the printing medium S. The cutter unit 3 is supported by a supporting member 5 so as to be able to move in parallel with the movement direction of the carriage 22, in other words, in the main scanning direction H. In the present embodiment, a home position HP3 of the cutter unit 3 is arranged, in the movement range of the carriage 22, on the opposite end from the end on the side where there is the home position HP2 of the carriage 22. In other words, the home position HP2 of the carriage 22 and the home position HP3 of the cutter unit 3 are arranged apart in the main scanning direction H so as to sandwich the passing region of the printing medium S. Furthermore, they are arranged apart in the main scanning direction H so as to sandwich the passing region of the printing medium S in the maximum size that is supported by the printing apparatus 1. Also, the sensor 24 that detects the existence or absence of the cutter unit 3 is arranged in the housing unit near the home position HP3 of the cutter unit 3 and can detect whether the cutter unit 3 is at HP3 (refer to FIG. 2). As the sensor 24, light-reflective optical sensors, ultrasonic sensors, and the like, for example, may be used.

Also, the cutter unit 3 is arranged so as to be able to connect with or separate from the carriage 22 by a connecting part 6 that is described later and follows the carriage 22 by connecting with the carriage 22 and then cuts the printing medium S. The printing medium S that was cut by the cutter unit 3 is conveyed by a conveyance roller pair 44 that is described later and then is discharged from a discharge port 18.

The conveyance unit 4 conveys the printing medium S that was unwound from the roll R. The conveyance unit 4 conveys the printing medium S following a supporting member 16 and a platen 17, which guide and support the printing medium S, from within the housing 12 to the discharge port 18. In the present embodiment, the conveyance unit 4 includes a plurality of conveyance roller pairs 41 to 44 that are arranged to be apart in the auxiliary scanning direction F. The plurality of the conveyance roller pairs 41 to 44 each include a drive roller that is driven by a conveyance motor (not illustrated) and a driven roller that is driven by the drive roller. Note that the drive rollers may be driven by a single conveyance motor or be separately driven by a plurality of conveyance motors that correspond to the respective drive rollers.

<Hardware Configuration>

Figure 3:
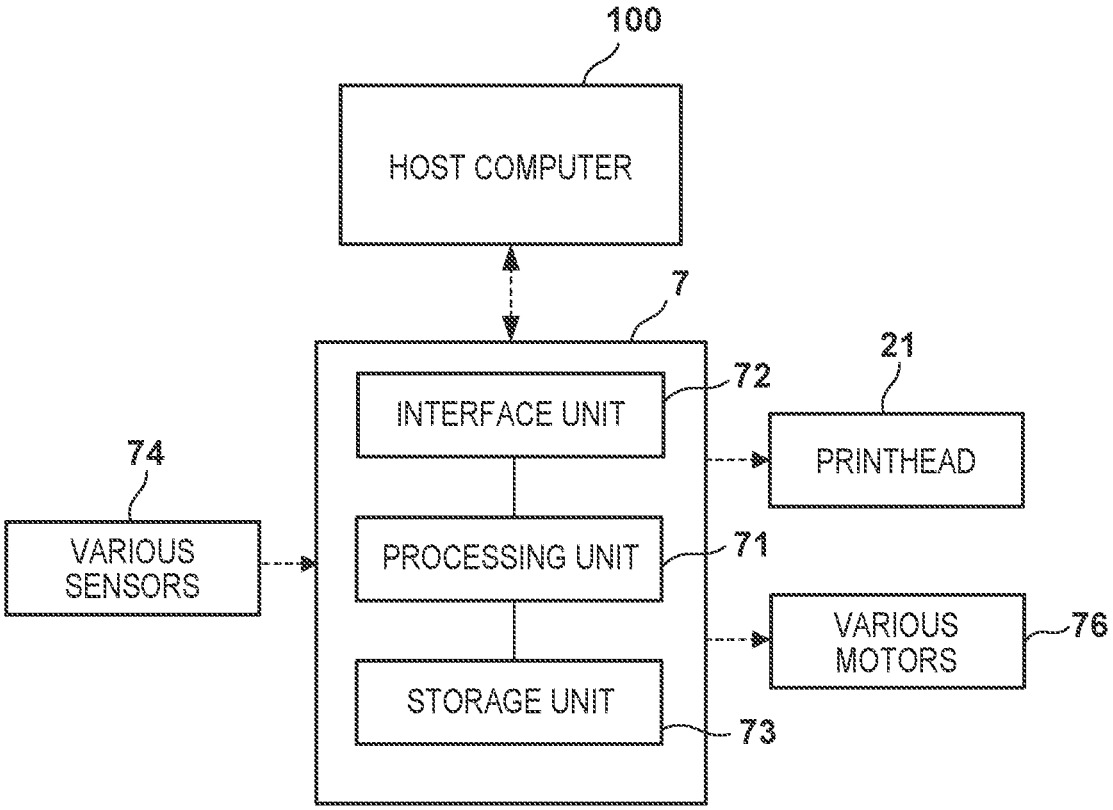
FIG. 3 is a block diagram that illustrates an example of a hardware configuration of the printing apparatus in FIG. 1.

FIG. 3 is a block diagram that illustrates an example of a hardware configuration of the printing apparatus 1. FIG. 3 is a block diagram of a control unit 7 of the printing apparatus 1. The control unit 7 includes a processing unit 71 such as a CPU, an interface unit 72 that performs an exchange of data with an external device, and a storage unit 73 such as a ROM and a RAM. The processing unit 71 reads and then executes a program that is stored in the storage unit 73. In calculation processing that is performed by the processing unit 71, image processing as well as processing for communication with a host computer 100 via the interface unit 72, for example, are included. Also, discharge control, which is performed based on the detection results of various sensors 74, of the printhead 21 comprised by the printing unit 2 and drive control of various motors 76, for example, are included. In various sensors 74, an encoder sensor for detecting the position of the carriage 22, the sensor 24 for detecting the position of the cutter unit 3, the sensor 25 that detects the edge of the sheet of the printing medium S, and the like are included. In various motors 76, the carriage motor 221, a conveyance motor (not illustrated), a sheet supplying motor (not illustrated) that rotationally drives the spool 14, and the like are included.

In the storage unit 73, a control program for controlling the printing apparatus 1, data that is necessary for executing the control program, and the like, for example are stored. Also, a configuration may be taken so as to save print data that was transmitted from the host computer 100, for example.

<Configuration of Cutter Unit and Connecting Part>

Figure 4A:
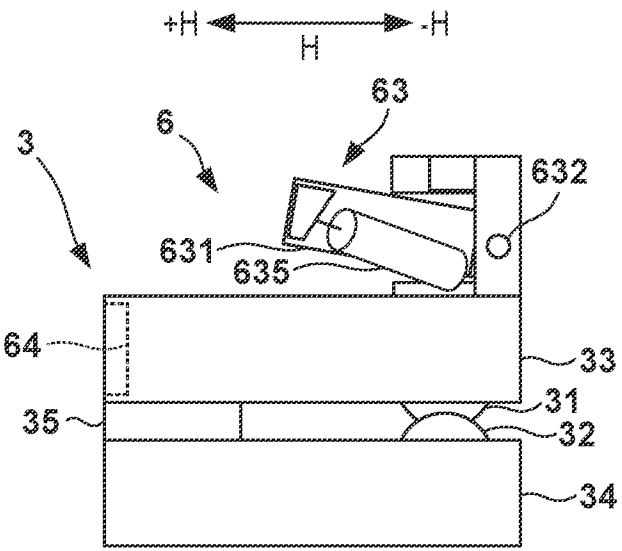
FIG. 4A is a view that illustrates a configuration of a cutter unit and a cutter unit side of a connecting part.
Figure 4B:
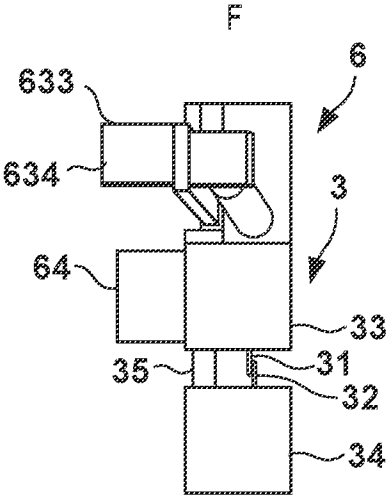
FIG. 4B is a view that illustrates a configuration of a cutter unit and a cutter unit side of a connecting part.
Figure 4C:
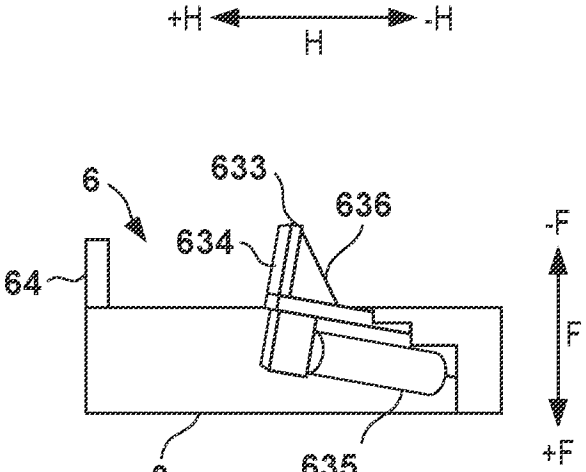
FIG. 4C is a view that illustrates a configuration of a cutter unit and a cutter unit side of a connecting part.
Figure 5A:
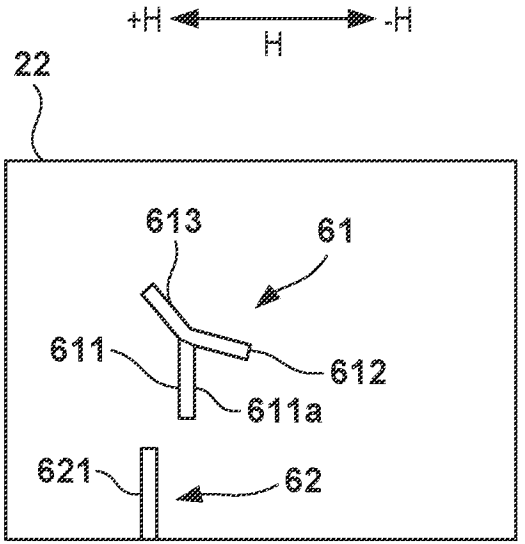
FIG. 5A is a view that illustrates a configuration of a carriage side of the connecting part.
Figure 5B:
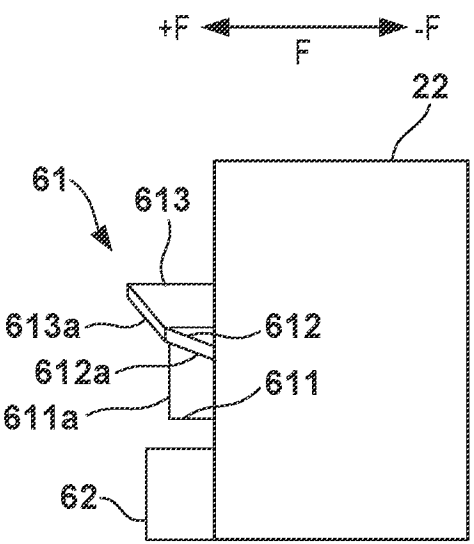
FIG. 5B is a view that illustrates a configuration of a carriage side of the connecting part.
Figure 5C:
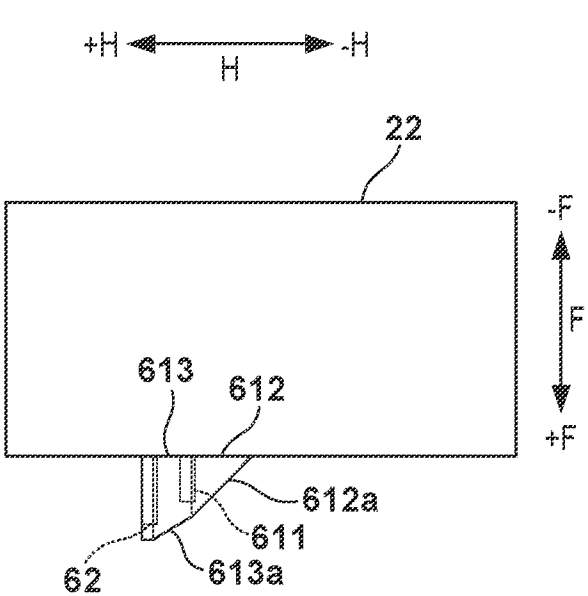
FIG. 5C is a view that illustrates a configuration of a carriage side of the connecting part.

FIG. 4A to FIG. 4C are views that illustrate the configurations of the cutter unit 3 and the cutter unit 3 side of the connecting part 6, FIG. 4A is a front surface view, FIG. 4B is a left side surface view, and FIG. 4C is a plan view. FIG. 5A to FIG. 5C are views that illustrate the configurations of the carriage 22 side of the connecting part 6: FIG. 5A is a front surface view, FIG. 5B is a right side surface view, and FIG. 5C is a plan view. Note that the front surface view of FIG. 4A and FIG. 5A are views of when the housing 12 is looked into from the discharge port 18 side.

The cutter unit 3 includes a first cutter blade 31, an upper holding member 33 that holds the first cutter blade 31 so it can rotate, a second cutter b lade 32, and a lower holding member 34 that holds the second cutter blade 32 so it can rotate. The upper holding member 33 and the lower holding member 34 are arranged so as to be apart in an up/down direction sandwiching a region through which the printing medium S passes and are connected by a connecting member 35. Also, the lower holding member 34 is supported by the supporting member 5 so as to be able to move in the main scanning direction H. For example, the first cutter blade 31 and the second cutter blade 32 rotate in accordance with the movement of the cutter unit 3 in the main scanning direction H and then cut the printing medium S by contacting, in a rotating state, the printing medium S.

The connecting part 6 is something for connecting/separating the carriage 22 and the cutter unit 3. In the present embodiment, a driving source that drives (scans) the cutter unit 3 is not arranged. Therefore, by the connecting part 6 connecting the cutter unit 3 and the carriage 22, the cutter unit 3 follows the movement of the carriage 22. The connecting part 6 includes a first coupling member 61 and a second coupling member 62 as a configuration of the carriage 22 side and includes a first engagement member 63 that engages with the first coupling member 61 and a second engagement member 64 that engages with the second coupling member 62 as a configuration of the cutter unit 3 side.

The first engagement member 63 engages with the first coupling member 61 when the cutter unit 3 moves to the main scanning direction −H side. The first engagement member 63 is positioned further in an upwards direction than the second engagement member 64 in the up/down direction. The second engagement member 64 has a lever 631 that extends from the upper holding member 33. The lever 631 is attached to the upper holding member 33 via a joint 632. The lever 631 is able to pivot in the up/down direction and the auxiliary scanning direction F with the joint 632 as the supporting point. The lever 631, in a state in which it is not connected with the carriage 22, is biased in the upwards direction and in the auxiliary scanning −F direction by a biasing member 635. The biasing member 635 is an elastic member such as a spring, for example.

On the distal end of the lever 631, an engagement claw 633 that extends towards the carriage 22 side (auxiliary scanning −F direction) is arranged. The engagement claw 633 has an engagement surface 634 on the distal end side of the lever 631 that spreads in a direction that intersects the main scanning direction H. In the present embodiment, the engagement surface 634 is a surface that intersects the main scanning direction H. Also, an inclination portion 636 that extends towards the auxiliary scanning direction +F side and the main scanning direction −H side from the end on the conveyance direction upstream side of the engagement claw 633 to the lever 631 is arranged.

The second engagement member 64 engages with the second coupling member 62 when the cutter unit 3 moves to the main scanning direction +H side. The first engagement member 63 is positioned further in a downwards direction than the second engagement member 64 in the up/down direction. The second engagement member 64 is a plate member that extends in the auxiliary scanning −F direction from the upper holding member 33.

The first coupling member 61 engages with the first engagement member 631 when the carriage 22 moves to the main scanning direction −H side. The first coupling member 61 is arranged so as to protrude from the side surface on the auxiliary scanning direction +F side of the carriage 22 in the auxiliary scanning +F direction. The first coupling member 61 includes a part 611 that extends in the up/down direction, a part 612 that extends in the main scanning −H direction and in the downward direction from the end in the upper side of the part 611, and a part 613 that extends in the main scanning +H direction and in an upwards direction from the end on the upper side of the part 611. The part 611 has a connecting surface 611*a* that spreads in a direction that intersects the main scanning direction H. In the present embodiment, the connecting surface 611*a* is a surface that spreads in a direction orthogonal to the main scanning direction H. Also, the part 612 includes an inclination portion 612*a* that is inclined in the main scanning +H direction and the auxiliary scanning +F direction from the end in the main scanning −H direction. Also, the part 613 includes an inclination portion 613*a* that is inclined in the main scanning +H direction and the auxiliary scanning +F direction from the end on the main scanning direction −H side.

The second coupling member 62 connects with the second engagement member 64 when the carriage 22 moves to the main scanning direction +H side. The second coupling member 62 is arranged further in a downward direction than the first coupling member 61 in the up/down direction. The second coupling member 62 is a plate-shaped member that that is long in the up/down direction and extends in the +F direction from the side surface on the auxiliary scanning direction +F side of the carriage 22. The second coupling member 62 has a connecting surface 621 that extends in a direction that intersects the main scanning direction H. In the present embodiment, the connecting surface 621 is a surface that is orthogonal to the main scanning direction H.

Figure 6A:
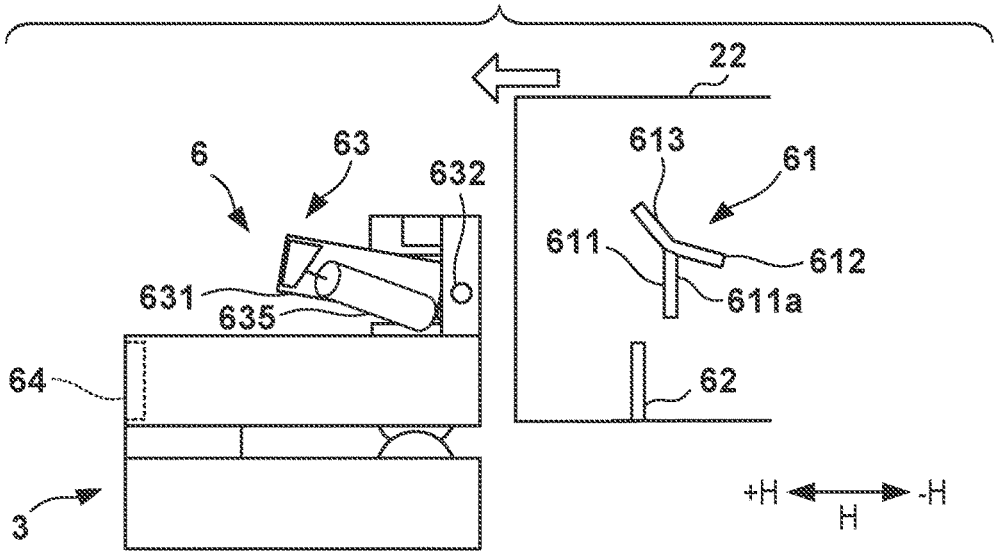
FIG. 6A is a view that schematically illustrates a connection operation of a connecting member.
Figure 7A:
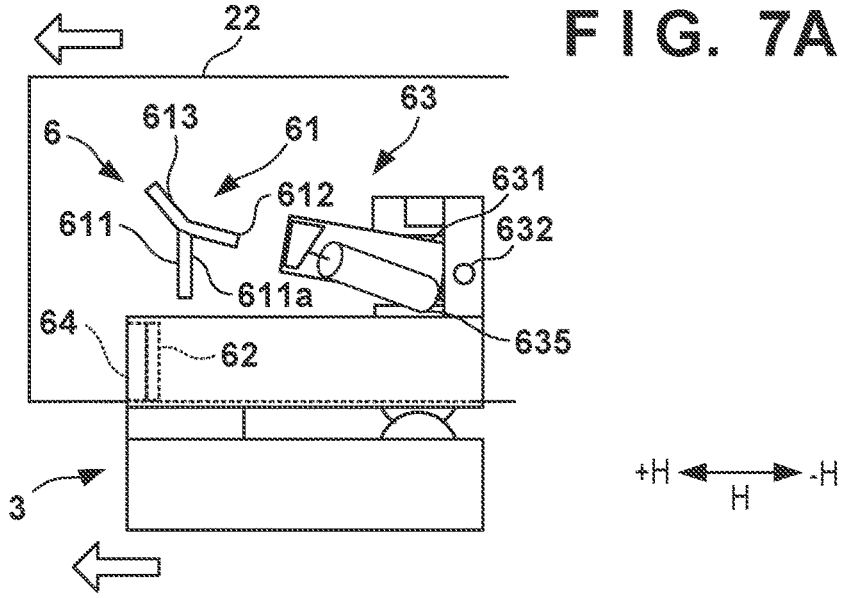
FIG. 7A is a view that schematically illustrates a disconnection operation of a connecting member.
Figure 7B:
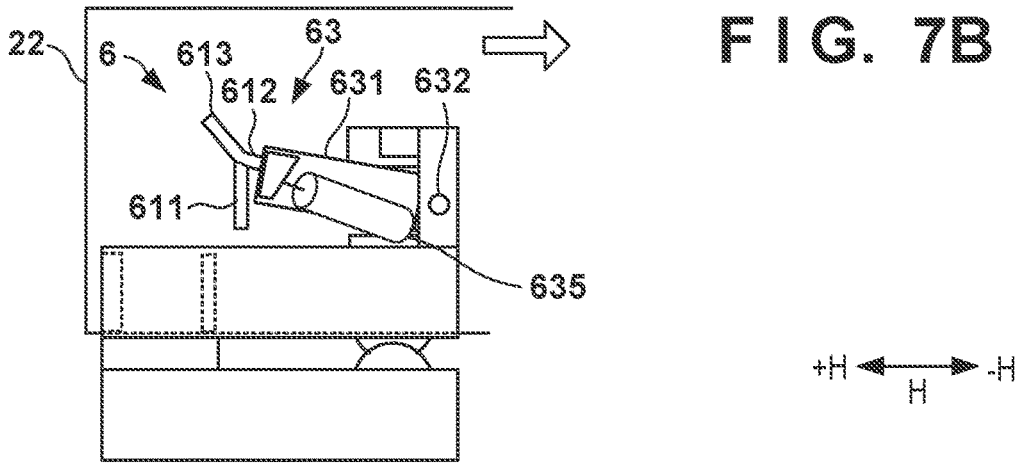
FIG. 7B is a view that schematically illustrates a disconnection operation of a connecting member.
Figure 7C:
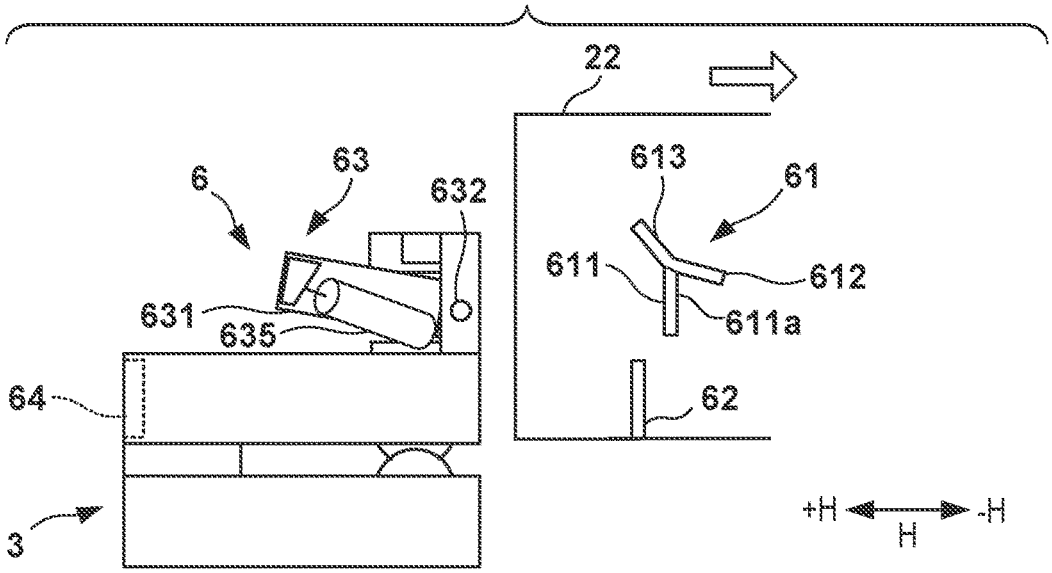
FIG. 7C is a view that schematically illustrates a disconnection operation of a connecting member.
Figure 8A:
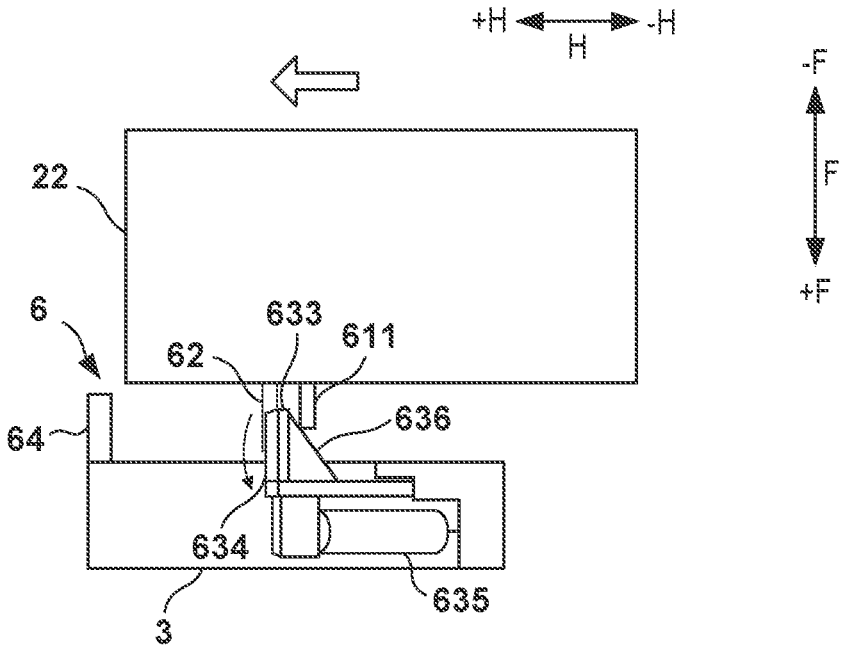
FIG. 8A is a plan view of a state in FIG. 6B.
Figure 8B:
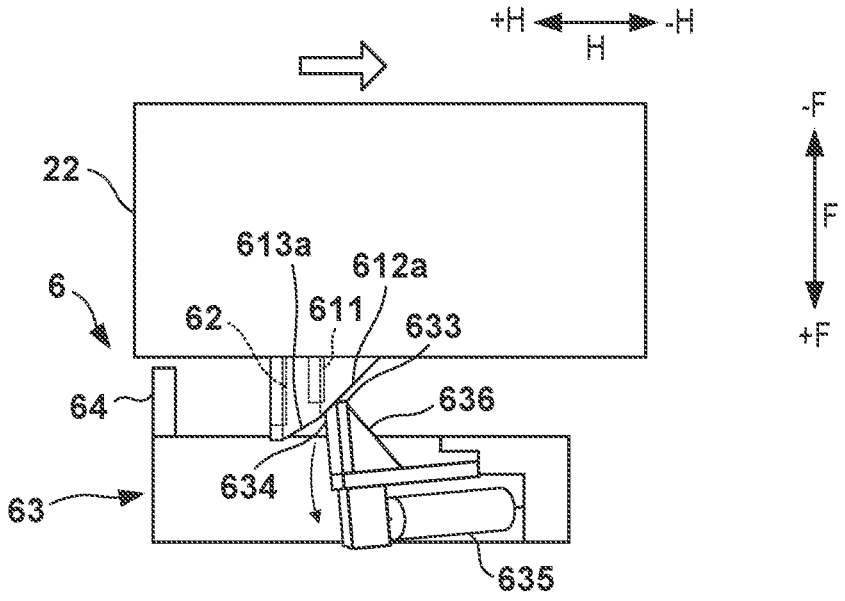
FIG. 8B is a plan view of a state in FIG. 7B.

Below, connection of the carriage 22 and the cutter unit 3 by the connecting part 6 and an operation for disengaging that connection will be described. FIG. 6A and FIG. 6C are views that schematically illustrates a connection operation of the connecting part 6. Also, FIG. 7A to FIG. 7C are views that schematically illustrate the disconnection operation of the connecting part 6. Also, FIG. 8A is a plan view of the state in FIG. 6B and a view in which the part 612 and the part 613 were omitted, and FIG. 8B is a plan view of the state in FIG. 7B.

While printing is being performed on the printing medium S by the printing unit 2, the cutter unit 3 is positioned further in the main scanning +H direction than a range in which printing is performed by the printing unit 2. The cutter unit 3 is positioned, for example, at the home position HP3 of the cutter unit 3 on the end in the main scanning +H direction or at a standby position WP (refer to FIG. 11) on a supporting member (supporting member 5) that was set by processing that will be described later. Then, when printing of an image to the printing medium S by the printing unit 2 is ended, the carriage 22 moves to the main scanning direction +H side to a position where the cutter unit 3 is in order to connect with the cutter unit 3 (FIG. 6A).

Figure 6B:
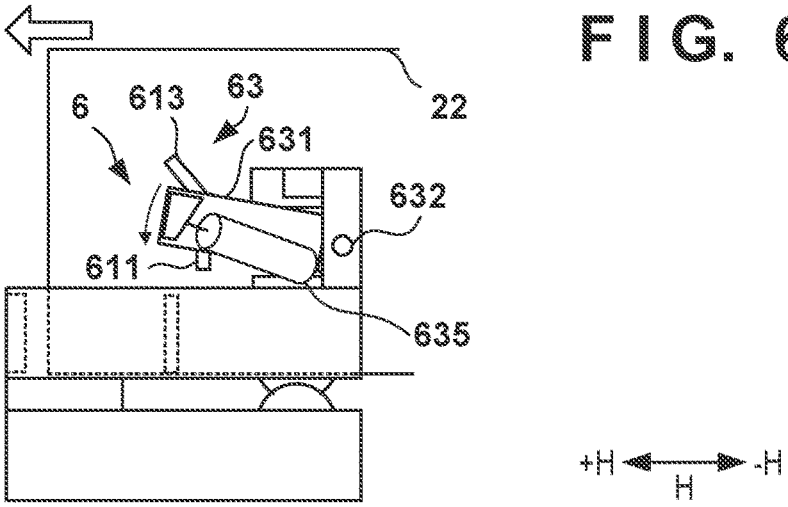
FIG. 6B is a view that schematically illustrates a connection operation of a connecting member.
Figure 6C:
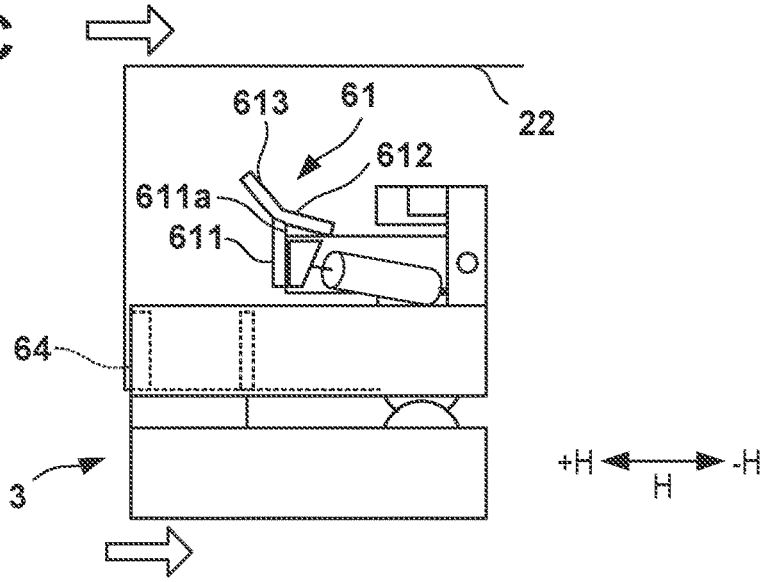
FIG. 6C is a view that schematically illustrates a connection operation of a connecting member.

As the carriage 22 moves to the main scanning direction +H side, the part 613 on the carriage 22 side and the engagement claw 633 of the first engagement member 63 on the cutter unit 3 side contact, and the lever 631 is caused to pivot in the downward direction by the bottom surface of the part 613 (FIG. 6B). Also, the inclination portion 636 of the first engagement member 63 contacts the part 611 (FIG. 8A), and the lever 631 also pivots to the auxiliary scanning direction +F side. By this, the engagement claw 633 will pass over the part 611 and be positioned on the main scanning direction −H side of the part 611.

After the engagement claw 633 passes over the part 611, when the carriage 22 switches the movement direction to be in the main scanning −H direction, the connecting surface 611*a* contacts with the engagement surface 634. By this, when the carriage 22 moves to the main scanning direction −H side, the engagement surface 634 is pressed by the connecting surface 611*a*, and so the cutter unit 3 is able to follow the movement of the carriage 22 (FIG. 6C).

In the present embodiment, the processing unit 71, having confirmed based on the detection result of the sensor 24 that the carriage 22 and the cutter unit 3 are in a positional relationship in which they are able to connect, connects the carriage 22 and the cutter unit 3 by reversing the movement direction of the carriage 22. In other words, the processing unit 71 performs control for connecting the carriage 22 and the cutter unit 3 by controlling the rotation of the carriage motor 221 based on the detection result of the sensor 24.

Next, disconnection of the carriage 22 and the cutter unit 3 will be described. After the cutter unit 3 cuts the printing medium S, it is necessary to disengage the connection of the carriage 22 and the cutter unit 3 in order for the printing unit 2 to print an image on the succeeding printing medium S. For this, when the carriage 22 switches the movement direction from the main scanning −H direction to the main scanning +H direction, the part 611 and the engagement claw 633 will no longer be in contact, and the second coupling member 62 will be pushing the second engagement member 64. By this, the cutter unit 3 follows the movement of the carriage 22 and moves to the main scanning +H side (FIG. 7A). Note that at this time, the lever 631 is pivoted in the upward direction by the biasing member 635.

When the cutter unit 3 reaches a predetermined position, the carriage 22 reverses the movement direction to the main scanning −H direction (FIG. 7B). Then, with the lever 631 in a state in which it is biased in the upwards direction and to the carriage 22 side by the biasing member 635, the engagement claw 633 pivots to the auxiliary scanning direction +F side following the inclination portion 612*a* of the part 612. As illustrated in FIG. 8B, in the position at which the part 611 and the part 612 connect, the protrusion amount, from the carriage 22, of the part 612 is greater than that of the part 611. By this, the engagement claw 633 will pass over the part 611 and be positioned on the main scanning direction +H side of the part 611. By this, the connection of the carriage 22 and the cutter unit 3 is disengaged, and so even if the carriage 22 further moves in the −H direction, contacting of the engagement claw 633 and the part 611 is avoided, and the cutter unit 3 will stop at a predetermined position (FIG. 7C).

In the present embodiment, the processing unit 71, having confirmed based on the detection result of the sensor 25 that the carriage 22 and the cutter unit 3 are in a predetermined position, disengages the connection between the carriage 22 and the cutter unit 3 by reversing the movement direction of the carriage 22. In other words, the processing unit 71 performs control for disconnection of the carriage 22 and the cutter unit 3 by controlling the rotation of the carriage motor 221 based on the detection result of the sensor 25. Note that the predetermined position where the connection between the cutter unit 3 and the carriage 22 is disengaged may be the standby position WP that is set by processing that is described later or the home position HP3 of the cutter unit 3, which is at the end on the main scanning direction +H side on the supporting member 5.

First Processing Example

Figure 9:
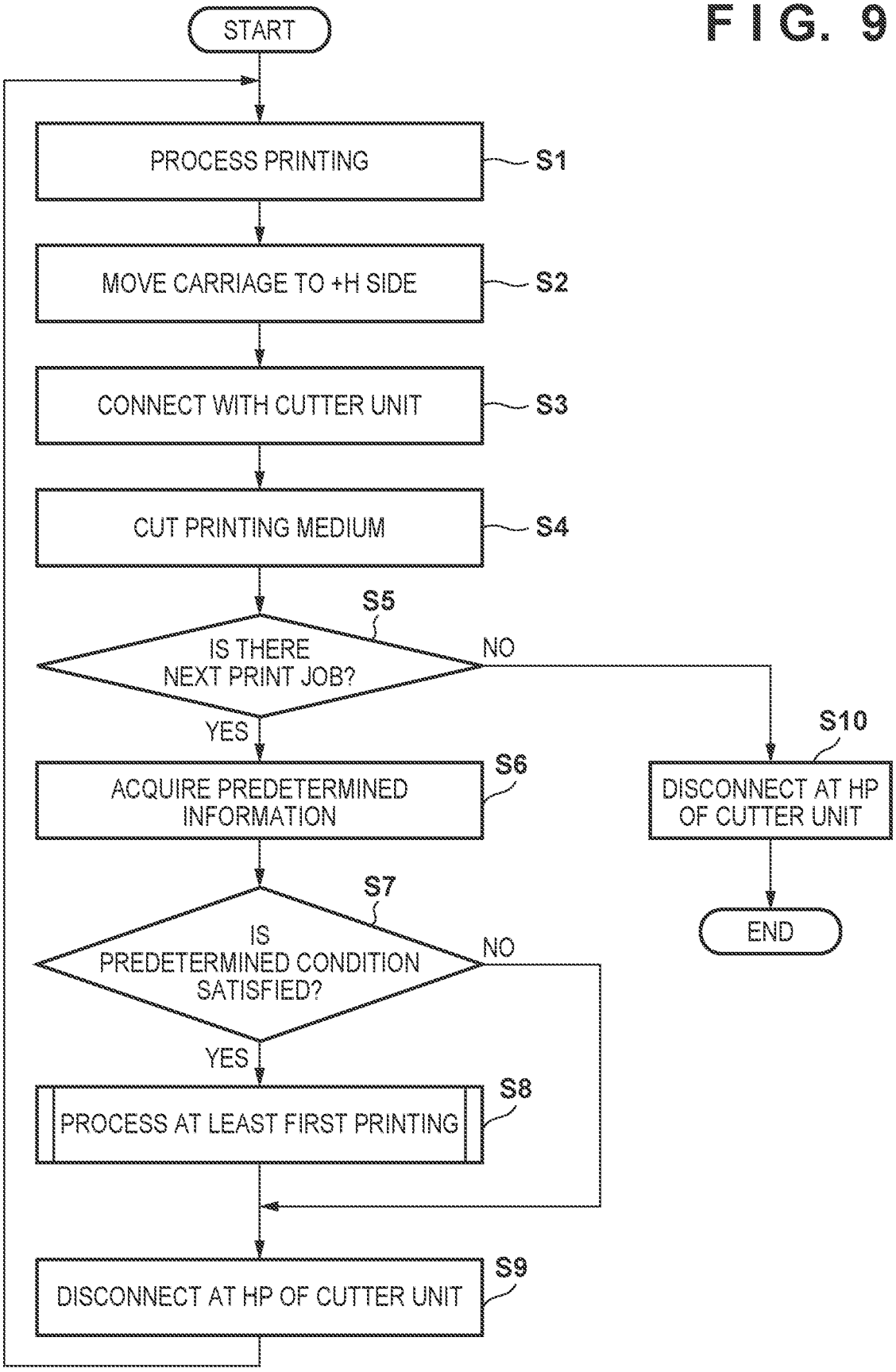
FIG. 9 is a flowchart that illustrates a processing example of a control unit.
Figure 10A:
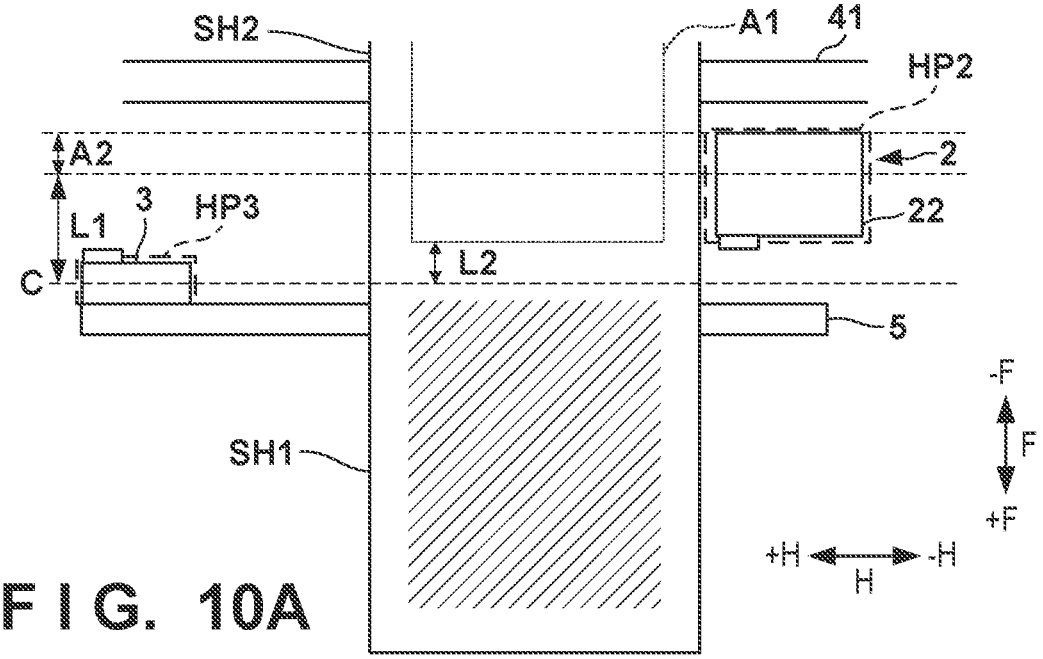
FIG. 10A is a view that schematically illustrates the state of the printing apparatus when the flowchart in FIG. 9 is being executed.
Figure 10B:
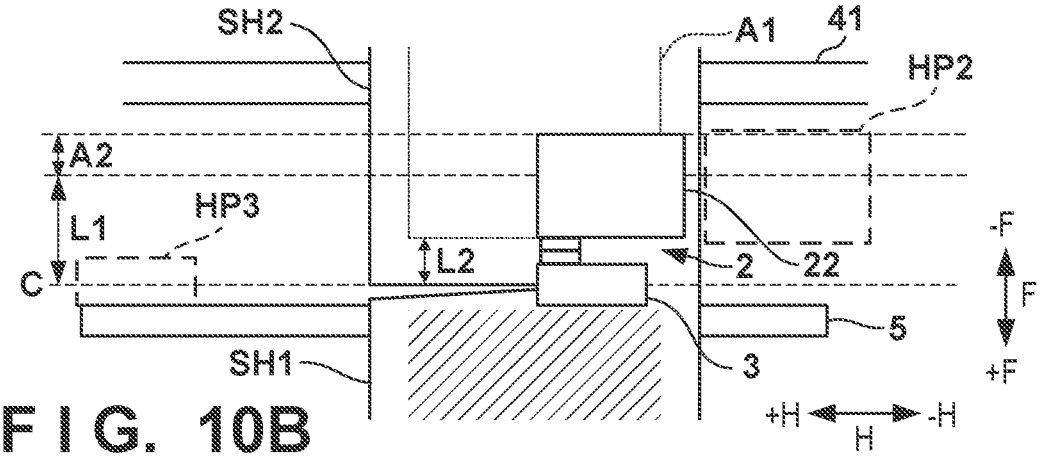
FIG. 10B is a view that schematically illustrates the state of the printing apparatus when the flowchart in FIG. 9 is being executed.
Figure 10C:
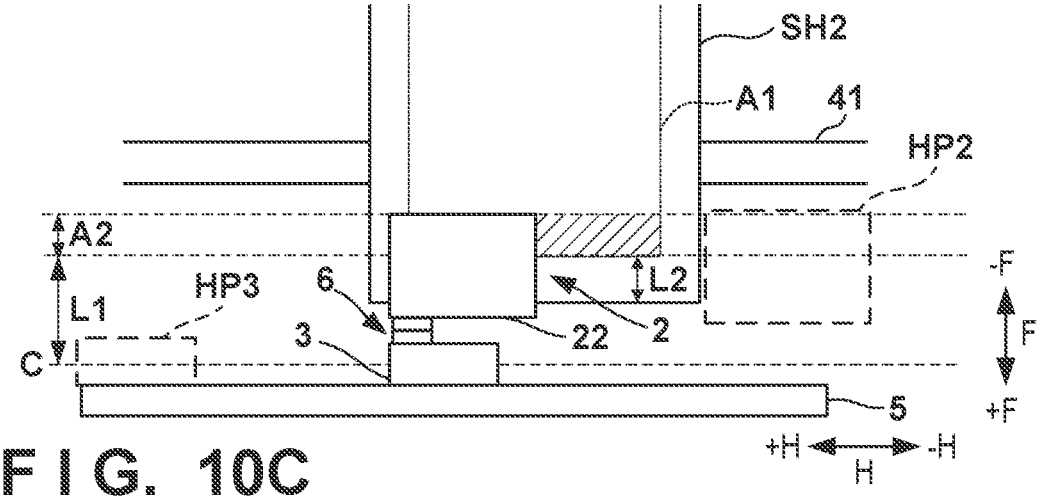
FIG. 10C is a view that schematically illustrates the state of the printing apparatus when the flowchart in FIG. 9 is being executed.

FIG. 9 is a flowchart that illustrates an example of processing by the control unit 7. The present flowchart is started in a case where a print job is executed by an instruction from the host computer 100, for example. Also, FIG. 10A to FIG. 10C are views that schematically illustrate states of the printing apparatus 1 when the flowchart in FIG. 9 is being executed.

In step S1, the processing unit 71 performs processing for printing an image on the printing medium S by the printing unit 2. FIG. 10A illustrates the state in which printing by the printing unit 2 has ended and the carriage 22 has returned to its home position HP2. Then, in step S2, the processing unit 71 causes the carriage 22 to move to a back position side, in other words, to the main scanning direction +H side, in order to connect the carriage 22 with the cutter unit 3.

In step S3, the processing unit 71 connects the carriage 22 and the cutter unit 3. For example, the processing unit 71, having confirmed based on the detection result of the sensor 24 that the carriage 22 and the cutter unit 3 are in a positional relationship in which they can connect, connects the carriage 22 and the cutter unit 3 by reversing the movement direction of the carriage 22.

In step S4, the processing unit 71 cuts a precedent printing medium SH1 by the cutter unit 3. Specifically, the processing unit 71, by causing the carriage 22 to move to the main scanning direction −H side, causes the cutter unit 3 to follow thereby cutting the printing medium S (FIG. 10B).

In step S5, the processing unit 71 confirms whether or not there is a next print job. The processing unit 71, in a case where there is a next print job, proceeds to the processing in step S6 and in a case where there is no next print job, proceeds to the processing in step S10.

In step S6, the processing unit 71 acquires predetermined information. In the present embodiment, the predetermined information that is acquired is a distance L2 from the edge on the auxiliary scanning direction +F side of a succeeding printing medium SH2 (in other words, the edge on the downstream side in the conveyance direction of the printing medium SH2) to a scheduled print area A1 in which an image is to be printed on the succeeding printing medium SH2.

In step S7, the processing unit 71 confirms whether or not a predetermined condition is satisfied. Specifically, the processing unit 71 confirms whether or not a distance L1 from a printing position A2 by the printhead 21 to a cutting position C by the cutter unit 3 is greater than the distance L2. The processing unit 71, in a case where the predetermined condition is satisfied (in other words, in a case where distance L1>distance L2), proceeds to step S8 and in a case where the predetermined condition is not satisfied, proceeds to step S9.

Note that the processing unit 71 may confirm, in step S7, in addition to the relationship of the distance L1 and the distance L2, whether or not information that is related to an image to be printed satisfies a predetermined condition. Due to vibration and the like, printing by the printing unit 2 in a state in which the carriage 22 and the cutter unit 3 are connected may not be suitable for printing that requires more accuracy. Thus, the processing unit 71 may acquire in step S6 information that is related to an image to be printed as predetermined information and determine in step S7 that the predetermined condition is not satisfied in a case where the image is of a high resolution (for example, the dpi is a predetermined value or greater), the mode is a photograph mode, or the like.

In step S8, the processing unit 71 performs by the printing unit 2 an initial print scan (in other words, printing of the first scan) related to the succeeding printing medium SH2 in a state in which the cutter unit 3 and the carriage 22 are connected (FIG. 10C). In other words, the processing unit 71 performs by the printing unit 2 some of the printing processing that is related to the succeeding printing medium SH2.

In step S9, the processing unit 71 disengages the connection of the carriage 22 and the cutter unit 3 at the home position HP3 of the cutter unit 3. Here, in a case the initial print scan that is related to the succeeding printing medium SH2 was performed in step S8, the carriage 22 after printing is positioned near the edge on the main scanning direction +H side of the printing medium SH2 (refer to FIG. 10C). Therefore, in a case where the carriage 22 moves the cutter unit 3 from this position to HP3 and then disconnects, the movement distance of the carriage 22 can be shortened more than a case where the carriage 22 moves the cutter unit 3 from HP2 of the carriage 22 to HP3 and then disconnects. Accordingly, the time that is required for disconnecting the cutter unit 3 and the carriage 22 can be reduced, and it becomes possible to improve the throughput of the printing apparatus 1.

Note that although the processing unit 71 returns to step S1 after the processing in step S9, in a case where in step S8 the initial print scan that is related to the printing medium SH2 is completed, in step S1 the remaining printing that is related to the printing medium SH2 is performed by the printing unit 2.

In a case where the processing proceeds from step S5 to S10, in step S10 the processing unit 71 disengages the connection between the carriage 22 and the cutter unit 3 at HP3 of the cutter unit 3 and then ends the flowchart.

As described above, by virtue of the present embodiment, when the predetermined condition is satisfied after the printing medium SH1 is cut by the cutter unit 3, the initial print scan that is related to the succeeding printing medium SH2 is performed in a state in which the cutter unit 3 and the carriage 22 are connected. Therefore, it becomes possible to improve the throughput of the printing apparatus 1 when compared to a case where the connection between the cutter unit 3 and the carriage 22 are disengaged after precedent printing medium SH1 is cut.

Figure 11:
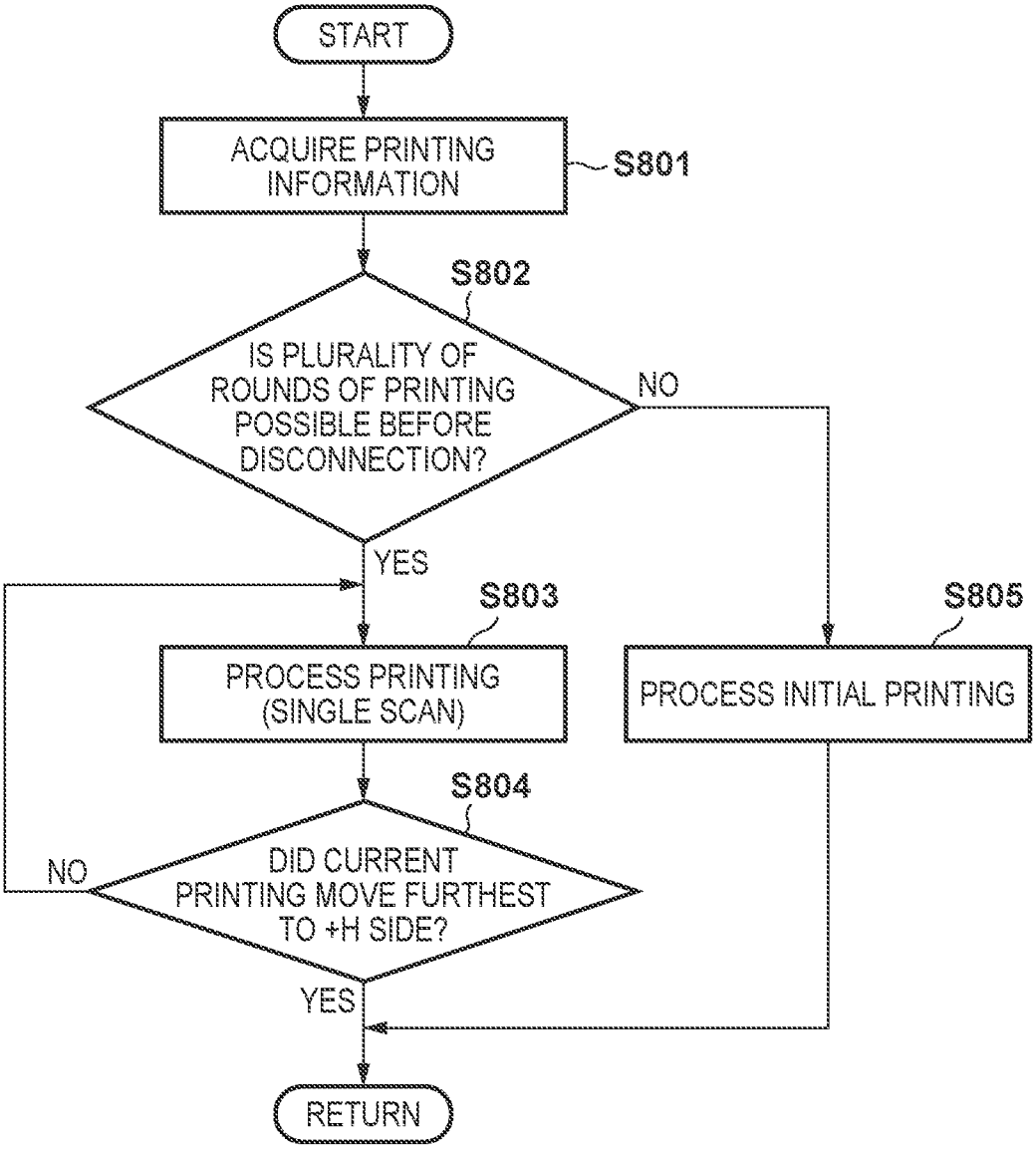
FIG. 11 is a flowchart that illustrates a processing example of a control unit.

FIG. 11 is a flowchart that illustrates an example of a subroutine of step S8.

In step S801, the processing unit 71 acquires printing information that is related to the succeeding printing medium SH2. For example, the processing unit 71 acquires printing information of the initial few scans that is related to the printing medium SH2.

In step S802, the processing unit 71 confirms whether or not a plurality of rounds of printing is possible before the disconnection of the cutter unit 3 and the carriage 22. In other words, the processing unit 71 confirms whether or not a plurality of rounds of printing is possible before the leading edge of the printing medium SH2 reaches the cutting position C of the cutter unit 3. The processing unit 71, in a case where a plurality of rounds of printing is possible, proceeds to step S803 and in a case where it is not possible, performs the initial printing processing in step S805 and then ends the processing of step S8.

In step S803, the processing unit 71 performs a single scan of printing. In step S804, the processing unit 71 confirms whether or not the current printing, among a plurality of rounds of printing before the disconnection, makes the carriage 22 move furthest to the +H side. The processing unit 71, in a case where the current printing makes the carriage 22 move the furthest to the +H side, ends the processing of step S8 and otherwise, returns to the processing in step S803.

According to the processing in FIG. 11, in a case where a plurality of rounds of printing is possible before the disconnection, the printing processing of step S8 is ended when the carriage 22 moves the furthest to the +H side and then performs the disconnection of the cutter unit 3 in step S9. In other words, the disconnection is performed after the scan of printing, among a plurality of rounds of printing, that comes the closest to the standby position of the cutter unit 3. Therefore, the movement distance of the carriage 22 for disconnection can be made shorter, and so the time that is required for disconnection can be reduced, and it becomes possible to improve the throughput of the printing apparatus 1. In other words, disconnection may be performed by identifying from print data a print scan in which the carriage 22 is scanned furthest in the main scanning +H direction in the duration up until the leading edge of the printing medium SH2 reaches the cutting position C. By this, the movement distance of the carriage 22 during disconnection can be made shorter.

Second Processing Example

Figure 12:
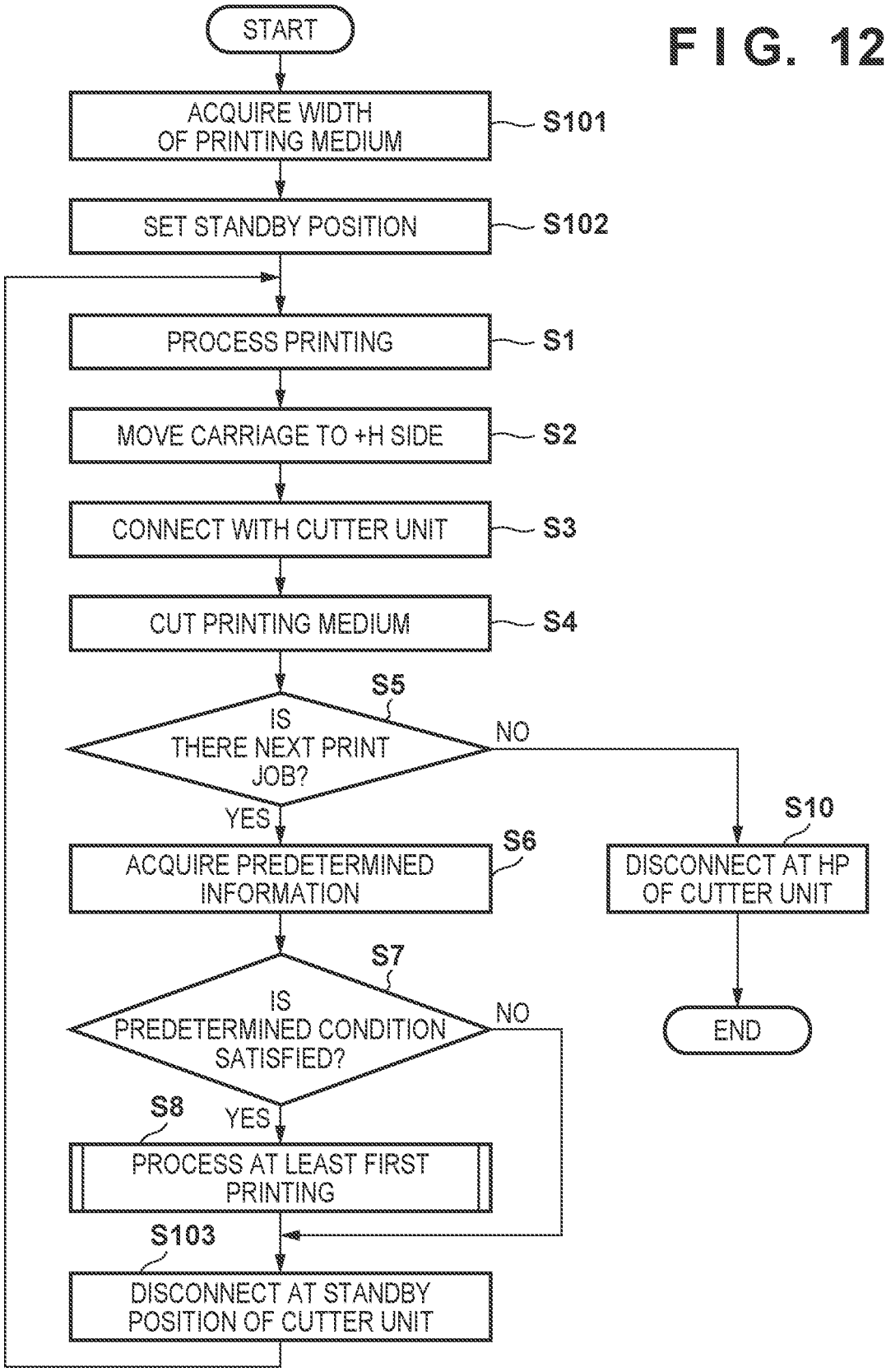
FIG. 12 is a flowchart that illustrates a processing example of a control unit.
Figure 13A:
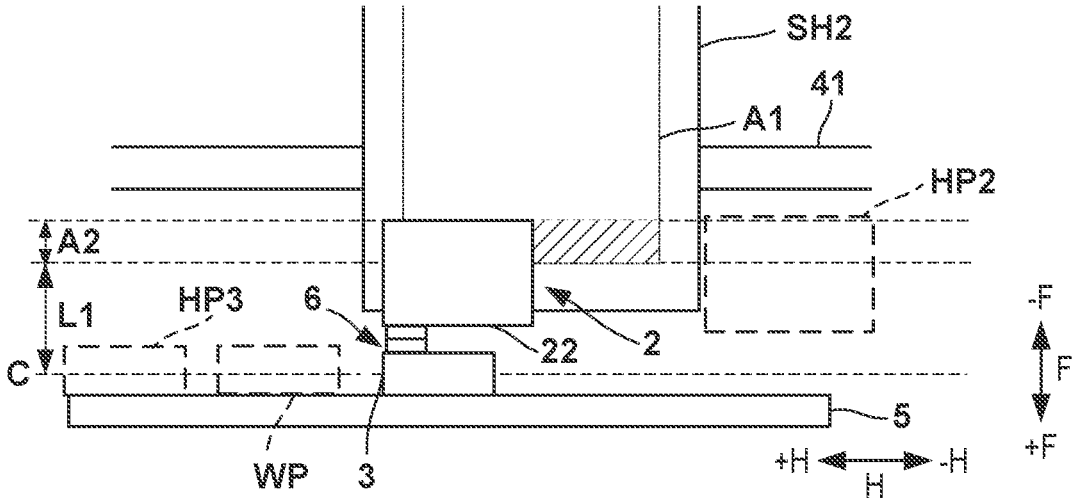
FIG. 13A is a view that schematically illustrates the state of the printing apparatus when the flowchart in FIG. 12 is being executed.
Figure 13B:
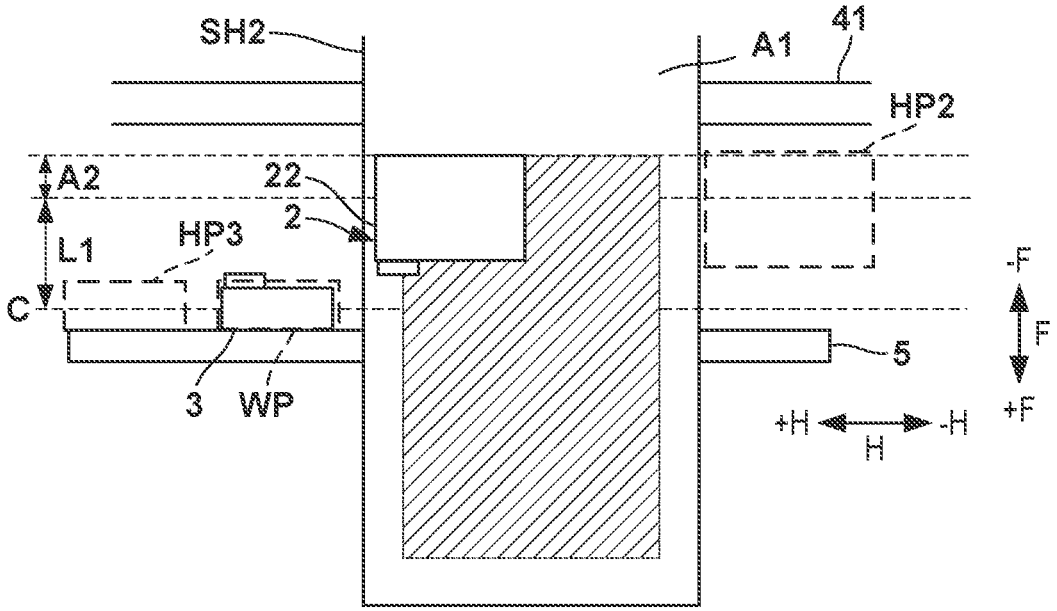
FIG. 13B is a view that schematically illustrates the state of the printing apparatus when the flowchart in FIG. 12 is being executed.

FIG. 12 is a flowchart that illustrates an example of processing by the control unit 7. In the second processing example, the position where the connection between the cutter unit 3 and the carriage 22 is disengaged after printing that is related to the succeeding printing medium SH2 is different from the first processing example. Also, FIG. 13A and FIG. 13B are views that schematically illustrate states of the printing apparatus 1 when the flowchart in FIG. 12 is being executed. Hereinafter, processing that is different from the first processing example will be described primarily and regarding processing that is the same, the same reference numerals will be assigned and description thereof will be omitted.

In step S101, the processing unit 71 acquires the size in the widthwise direction, in other words, the auxiliary scanning direction F, of the printing medium S. In the present embodiment, the processing unit 71 acquires the width of the printing medium S based on the detection result of the sensor 25 that is able to detect the edge of the printing medium S. However, the processing unit 71 may acquire the width of the printing medium S based on setting information of a sheet size that is inputted by a user.

In step S102, the processing unit 71 sets the standby position WP of the cutter unit 3 on the supporting member 5 in accordance with the size of the printing medium S. For example, the processing unit 71 sets the standby position WP of the cutter unit 3 at a position that is apart by a predetermined distance from the edge on the main scanning direction +H side of the printing medium S based on the size of the printing medium S acquired in step S1. For example, the standby position WP is a position that is separated by 0 to 50 mm in the main scanning +H direction from the edge on the main scanning direction +H side of the printing medium S. For example, the standby position WP is a position that is separated by 10 to 30 mm in the main scanning +H direction from the edge on the main scanning direction +H side of the printing medium S.

Note that the processing unit 71 may store in the storage unit 73 in association with the size of the printing medium S information regarding the set standby position WP. Also, the processing unit 71, in a case where the size of the printing medium S acquired in step S1 is the same as the size that is stored in the storage unit 73, may use the stored standby position WP and in a case where the size is changed, may change the setting of the standby position WP.

In step S103, the processing unit 71 disengages the connection of the carriage 22 and the cutter unit 3 at the standby position WP of the cutter unit 3. The carriage 22 after printing is positioned near the edge on the main scanning direction +H side of the printing medium SH2 (refer to FIG. 13A). Because the distance from this position to the standby position WP is shorter than the distance from this position to the home position HP3, the movement distance of the carriage 22 for disconnection can be made shorter. Also, when printing that is related to the succeeding printing medium SH2 is ended and then the carriage 22 and the cutter unit 3 connects again, because the cutter unit 3 is waiting at the standby position WP which is at a position that is closer than the home position HP3 of the cutter unit 3, the movement distance of the carriage 22 for connection is made shorter.

As described above, in the present processing example, the standby position of the cutter unit 3 is set in accordance with the size of the printing medium S. Accordingly, when compared to a case where the cutter unit 3 waits at HP3, the movement distance of the carriage 22 will be shorter when the carriage 22 connects with the cutter unit 3 or disengages that connection. Therefore, the time that is required for cutting the printing medium S is shortened, and it is possible to improve the throughput of the printing apparatus 1.

Other Embodiments

In the above embodiment, the connecting part 6 performs the connection and disengagement between the cutter unit 3 and the carriage 22 by a mechanical configuration. However, no limitation is made to the embodiment of the connection. For example, an actuator that can move back and forth in the auxiliary scanning direction F and is electrically driven may be arranged on either the cutter unit 3 or the carriage 22 and an engagement unit that engages with this actuator may be arranged on the other. Then, the processing unit 71, by controlling the operation of this actuator, may perform the connection and disengagement between the cutter unit 3 and the carriage 22.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-239281 filed Dec. 27, 2019 which is hereby incorporated by reference herein in its entirety.

What is claimed is:

1. A printing apparatus comprising:

a printing unit configured to print an image on a printing medium and configured to move in a scanning direction;

a cutter unit configured to be able to connect with or separate from the printing unit, and configured to cut the printing medium by moving with the printing unit; and a control unit configured to perform:

(1) a first control in which (a) the cutter unit is separated from the printing unit, and (b) the printing unit performs printing with moving in the scanning direction;

(2) a second control in which (a) the cutter unit is connected with the printing unit and cuts the printing medium by moving with the printing unit, and (b) the printing unit does not perform printing; and (3) a third control in which, in a case where a predetermined condition is satisfied after the printing medium is cut by the cutter unit, the printing unit performs printing on a succeeding printing medium, while moving the printing unit in a state in which the cutter unit is connected with the printing unit.

2. The printing apparatus according to claim 1, further comprising a conveyance unit configured to convey a printing medium in a conveyance direction intersecting the scanning direction, wherein the cutter unit is provided downstream of the printing unit in the conveyance direction, and wherein the predetermined condition is that a first distance, from a downstream edge of the succeeding printing medium in the conveyance direction to a downstream edge of an image to be printed on the succeeding printing medium, is smaller than a second distance, from a downstream edge of a print head of the printing unit to a cutting position by the cutter unit.

3. The printing apparatus according to claim 2, wherein the control unit, in a case where the predetermined condition is not satisfied, disengages a connection between the printing unit and the cutter unit before performing printing on the succeeding printing medium.

4. The printing apparatus according to claim 3, wherein the control unit disengages the connection in a state where the cutter unit is positioned at a standby position in the scanning direction.

5. The printing apparatus according to claim 4, wherein a standby position of the printing unit and the standby position of the cutter unit are arranged so as to sandwich a passing region, through which the printing medium passes, in the scanning direction.

6. The printing apparatus according to claim 4, wherein the control unit causes the printing unit to perform printing by moving in the scanning direction for a plurality of times in a case where the predetermined condition is satisfied before the downstream edge of the succeeding printing medium reaches the cutting position.

7. The printing apparatus according to claim 6, wherein the control unit disengages the connection at the standby position after a movement for printing which comes closer to the standby position among the plurality of times of a movement.

8. The printing apparatus according to claim 4, further comprising a change unit configured to change the standby position of the cutter unit.

9. The printing apparatus according to claim 4, wherein the standby position of the cutter unit is at a position that is apart b y a predetermined distance from an edge in the scanning direction of the printing medium.

10. The printing apparatus according to claim 2, wherein the control unit disengages a connection between the printing unit and the cutter unit after an initial movement for printing the succeeding printing medium is performed.

11. The printing apparatus according to claim 1, wherein the control unit, in a case where a predetermined condition that is related to an image to be printed is satisfied, does not allow the printing unit to perform printing on the succeeding printing medium in a state in which the cutter unit and the printing unit are connected.

12. The printing apparatus according to claim 1, wherein the printing unit includes a first member and a second member, wherein the cutter unit includes a third member and a fourth member, wherein the cutter unit, by the first member and the third member contacting, moves in accordance with a movement of the printing unit in a first direction, wherein the cutter unit, by the second member and the fourth member contacting, moves in accordance with a movement of the printing unit in a second direction opposite to the first direction, and wherein, by the cutter unit moving in the second direction in accordance with a movement of the printing unit, a contact between the first member and the third member is avoided in a case where the printing unit reverses from the second direction to the first direction.

13. A control method of a printing apparatus, the printing apparatus comprising a printing unit configured to print an image on a printing medium and configured to move in a scanning direction, and (b) a cutter unit configured to be able to connect with or separate from the printing unit, and configured to cut the printing medium by moving with the printing unit, the method comprising:

performing a first control in which (a) the cutter unit is separated from the printing unit, and (b) the printing unit performs printing with moving in the scanning direction;

performing a second control in which (a) the cutter unit is connected with the printing unit and cuts the printing medium by moving with the printing unit, and (b) the printing unit does not perform printing; and performing a third control in which, in a case where a predetermined condition is satisfied after the printing medium is cut by the cutter unit, the printing unit performs printing on a succeeding printing medium while moving the printing unit in a state in which the cutter unit is connected with the printing unit.

14. The control method according to claim 13, wherein the printing apparatus further comprises a conveyance unit configured to convey a printing medium in a conveyance direction intersecting the scanning direction, wherein the cutter unit is provided downstream of the printing unit in the conveyance direction, and wherein the predetermined condition is that a first distance, from a downstream edge of the succeeding printing medium in the conveyance direction to a downstream edge of an image to be printed on the succeeding printing medium, is smaller than a second distance, from a downstream edge of a print head of the printing unit to a cutting position by the cutter unit.

15. The control method according to claim 14, wherein the control unit, in a case where the predetermined condition is not satisfied, disengages a connection between the printing unit and the cutter unit before performing printing on the succeeding printing medium.

16. The control method according to claim 15, wherein the control unit disengages the connection in a state where the cutter unit is positioned at a standby position in the scanning direction.

17. The control method according to claim 16, wherein the control unit causes the printing unit to perform printing by moving in the scanning direction for a plurality of times in a case where the predetermined condition is satisfied before the downstream edge of the succeeding printing medium reaches the cutting position.

18. The control method according to claim 17, wherein the control unit disengages the connection at the standby position after a movement for printing which comes closer to the standby position among the plurality of times of a movement.

19. The control method according to claim 14, wherein the control unit disengages a connection between the printing unit and the cutter unit after an initial movement for printing the succeeding printing medium is performed.

20. A non-transitory computer-readable storage medium storing a computer program for causing a method to be performed by a printing apparatus, the printing apparatus comprising (a) a printing unit configured to print an image on a printing medium and configured to move in a scanning direction, and (b) a cutter unit configured to be able to connect with or separate from the printing unit, and configured to cut the printing medium by moving with the printing unit, the method comprising:

performing a first control in which (a) the cutter unit is separated from the printing unit, and (b) the printing unit performs printing with moving in the scanning direction;

performing a second control in which (a) the cutter unit is connected with the printing unit and cuts the printing medium by moving with the printing unit, and (b) the printing unit does not perform printing; and performing a third control in which, in a case where a predetermined condition is satisfied after the printing medium is cut by the cutter unit, the printing unit performs printing on a succeeding printing medium while moving the printing unit in a state in which the cutter unit is connected with the printing unit.

* * * * *